United States Patent [19]

Mikic et al.

[11] Patent Number: 4,497,405

[45] Date of Patent: Feb. 5, 1985

[54] WRENCH HOLDER

[75] Inventors: Frank Mikic; John E. Fuhreck; Larry D. Pacetti, all of Kenosha, Wis.

[73] Assignee: Snap-on Tools Corporation, Kenosha, Wis.

[21] Appl. No.: 627,057

[22] Filed: Jul. 2, 1984

[51] Int. Cl.[3] ..... B65D 85/62

[52] U.S. Cl. ..... 206/378; 206/493; 206/375

[58] Field of Search ..... 206/376, 378, 375, 493; 211/70.6

[56] References Cited

U.S. PATENT DOCUMENTS

| | | | |
|---|---|---|---|
| 1,750,011 | 3/1930 | Kneier | 206/376 |
| 2,068,308 | 1/1937 | Zerver | 206/376 |
| 2,219,721 | 10/1940 | Ingwer et al. | 206/378 |
| 2,720,306 | 10/1955 | Zubricky | 206/376 |
| 4,337,860 | 7/1982 | Carrigan | 206/378 |
| 4,346,804 | 8/1982 | Powderly | 206/493 |

*Primary Examiner*—William T. Dixson, Jr.

*Attorney, Agent, or Firm*—Emrich & Dithmar

[57] ABSTRACT

The wrench holder comprises a pair of elongated, plastic members that slide or telescope together. Each of the members includes a body and a pair of bifurcated legs extending therefrom. The members pass through openings in a set of wrenches and telescope or slide together. Heads respectively at the ends of the elongated members retain the wrenches therebetween. A latching element at the distal ends of the legs and another latching element on the body in the region of the head enable the two members to be releasably interconnected.

16 Claims, 8 Drawing Figures

WRENCH HOLDER

BACKGROUND OF THE INVENTION

Wrench sets such as crowfoot wrench sets and torque-adapter wrench sets consist of a plurality of wrenches respectively having wrenching surfaces of different sizes. Each wrench has an opening that matches the polygonal end of the shank of a drive tool for removably receiving same. The drive tool could be a ratchet, a breaker bar, a speeder, an extension, or the like. In order to keep the wrenches together, a device may be provided with which the wrenches can be removably engaged. Then, when one is needed it is removed, used and thereafter re-engaged to the device. In the past, one such device has been a plate containing a plurality of studs onto which the wrenches are press fit. These are undesirable as the wrenches could inadvertently fall off and become lost. Another device that has been available is a bar onto which the wrenches are slid. A detent at each end of the bar prevents the wrenches from becoming inadvertently dislodged. However, such a device is impractical to use because to gain access to a wrench not at one of the ends, up to half of the wrenches must first be removed.

SUMMARY OF THE INVENTION

An object of the present invention is to provide a holder for a plurality of wrenches in which the wrenches are securely retained in place when they are not used.

Another object is to provide a holder for a plurality of wrenches in which any wrench can be removed and utilized without removing any of the other wrenches.

Another object is to provide a wrench holder which is economical to make and easy to use.

In summary, there is provided a wrench holder for a set of wrenches each having an opening for receiving the shank end of a drive tool, comprising a pair of elongated members, each of the members including an elongated body and a pair of substantially parallel legs extending therefrom, the cross-sectional size of the body and the legs being less than the size of the wrench opening so that the body and the legs can be passed through and pulled out of such openings, the legs and the body of one of the elongated members slidably interfitting with the legs and the body of the other of the elongated members, each of the elongated members further including a head on the end of the body thereof remote from the associated legs, the cross-sectional size of each head being greater than the size of each wrench opening so that the wrenches are retained on the wrench holder when the legs are interfitted.

In a more specific form of the invention, there is provided a wrench holder for a set of wrenches each having an opening for receiving the shank end of a drive tool, comprising a pair of elongated members, each of the members including an elongated body and a pair of substantially parallel legs extending therefrom, the cross-sectional size of the body and the legs being less than the size of the wrench opening so that the body and the legs can be passed through and pulled out of such openings, the legs and the body of one of the elongated members slidably interfitting with the legs and the body of the other of the elongated members, each of the elongated members further including a head on the end of the body thereof remote from the associated legs, the cross-sectional size of each head being greater than the size of each wrench opening so that the wrenches are retained on the wrench holder when the legs are interfitted, first latching means on the legs at the ends thereof remote from the body, and second latching means on the body at the end thereof remote from the legs, the first latching means on one of the elongated members engaging the second latching means on the other of the elongated members, the first latching means on the other elongated member engaging the second latching means on the one elongated member.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2, 3, 4, 5, 6, 7, 8:
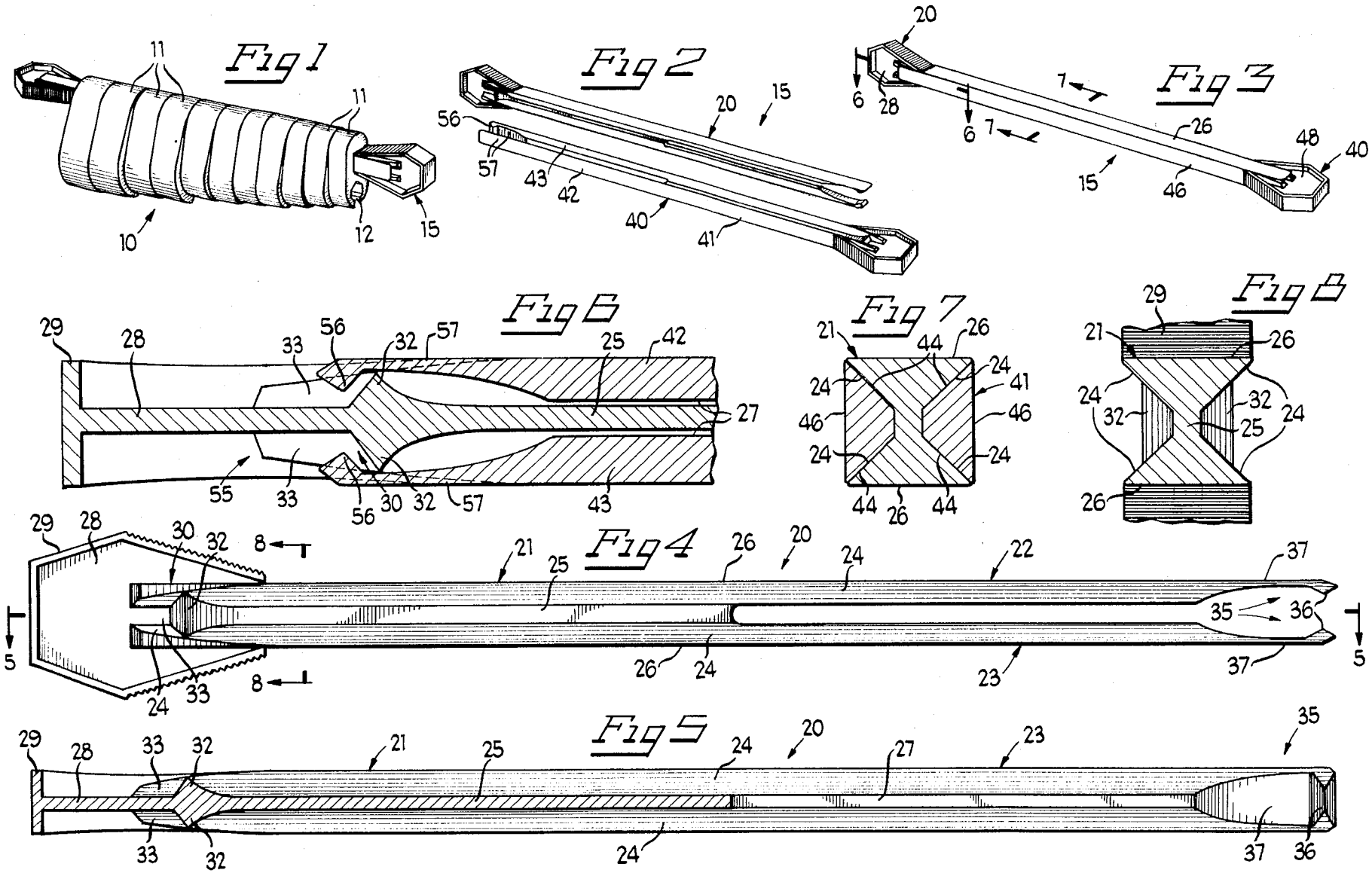
FIG. 1 depicts a wrench holder incorporating the features of the present invention onto which there is threaded or engaged a plurality of wrenches.
FIG. 2 is a perspective view of the two elongated members that comprise the wrench holder, in their disassembled condition.
FIG. 3 is a perspective view of the elongated members in assembled condition.
FIG. 4 is an enlarged, side elevational view of one of the elongated members.
FIG. 5 is a view in section taken along the line 5—5 of FIG. 4.
FIG. 6 is an enlarged view in section taken along the line 6—6 of FIG. 3.
FIG. 7 is an enlarged view in section taken along the line 7—7 of FIG. 3.
FIG. 8 is a view in enlarged section of one of the elongated members taken along the line 8—8 of FIG. 4.

Turning now to the drawings and more particularly to FIG. 1 thereof, there is depicted a wrench assembly 10 including a plurality of so-called "crowfoot" wrenches 11 and a wrench holder 15 incorporating the features of the present invention. Each of the wrenches 11 has a wrenching surface 12 for engaging a nut, the head of a bolt, etc. Also, each wrench 11 includes a polygonal opening (not shown), preferably square, to receive the shank end of a drive tool (not shown). The wrench holder 15 passes through the wrench opening in each of the wrenches 11 to provide the compact wrench assembly 10 depicted in FIG. 1.

Referring to FIGS. 2 and 3, the wrench holder 15 includes a pair of identical, one-piece, elongated members 20 preferably constructed of plastic. In FIG. 2 the elongated members 20 and 40 are shown separated and in FIG. 3 they are depicted in the assembled or telescoped condition which is the same as that depicted in FIG. 1.

Referring to FIGS. 4–8, the elongated member 20 includes an elongated body 21 and a pair of elongated, longitudinally extending, parallel legs 22 and 23 extending from one end of the body 21. The elongated member 20 includes four longitudinally extending planar slide surfaces 24. As is best seen in FIG. 8, the slide surfaces 24 converge toward the longitudinal axis of the member 20. Approximately one-half the length of each slide surface 24 is in the region of the body 21 and the other half is in the region of the corresponding leg 22 or 23 as the case may be. The slide surfaces 24 are oriented such that there is a 90° angle between each pair of surfaces.

As shown in FIG. 8, the cross-section of the body 21 is generally hourglass in shape, the portion between the two sections of the hourglass being defined by a web 25. The elongated member has a pair of outer surfaces 26. The slide surfaces 24 on each of the legs 22 and 23 intersect at an inner surface 27 (FIG. 5) which is generally parallel to the outer surface 26.

At the end of the body 21 remote from the legs 22 and 23 is a head 28 that is generally plate-like and contains the axis of the elongated member 20. The head 28 has an irregular hexagonal outline surrounded by a wall 29. Two of the surfaces of the wall 29 are serrated to facilitate gripping. Other shapes would be satisfactory.

In the region of the head 28 is a first latching element 30 in part defined by a projection 32. The space between the surfaces 24 (FIG. 4) and to the outside of the projection 32 defines a receptacle 33. Both surfaces of the projection 32 are inclined to define ramps. A second latching element 35 is located on the free end of each of the legs 22 and 23. Each of the latching elements 35 includes a nib 36 and a constricted portion between the nib 36 and the associated leg 22,23. Both surfaces of the nib 36 are inclined to define ramps.

The elongated member 40 is identical to the elongated member 20 and it has associated latching elements 50 and 55 which are respectively identical to the latching elements 30 and 35. Some of the parts of the elongated member 40 and the latching elements 50 and 55 are depicted and they are marked with corresponding reference numerals with 20 added thereto.

Because about one-half the length of the slide surface 24 is on the leg 22,23 and the other half is on the body 21, the legs 42 and 43 of the member 40 will be in juxtaposition with the body 21 when the members 20 and 40 are engaged. Similarly, the legs 22 and 23 will be in juxtaposition with the body 41. When assembled, the wrench holder 15 is substantially square shaped in transverse cross section as depicted in FIGS. 3 and 7 having outer surfaces 26 and 46. The distance between the outer surfaces 26 of the member 20 is less than the flat-to-flat dimension of the square opening in each of the wrenches 11. Likewise, the distance between the outer surfaces 46 of the elongated member 40 is less than such flat-to-flat dimension. Accordingly, the elongated members 20 and 40 are slidable within these square openings. Whereas the elongated members 20 and 40 are flexible when disassembled as shown in FIG. 2, they become rigid when in their assembled form depicted in FIG. 3.

In use, the crowfoot wrenches 11 are first threaded onto the elongated member 20. The elongated member 40 is oriented 90° with respect to the member 20. The nibs 56 are located in the space between the legs 22 and 23. Likewise, the nibs 36 of the elongated member 20 are located between the legs 42 and 43 of the elongated member 40. The elongated member 40 is pushed through the openings in the wrenches 11. The four slide surfaces 24 of the elongated member 20 respectively engage the four slide surfaces 44 of the elongated member 40 (FIG. 7). The members 20 and 40 could be slid together while holding the heads 28 and 48. When the members 20 and 40 are nearly telescoped or interfitted, the nibs 56 of the elongated member 40 engage the shallower ramps of the projections 32, respectively. The constricted portions 57 deflect outwardly, enabling continued movement until the nibs 56 clear the projections 32 and snap into the receptacles 33, as depicted in FIG. 6. Precisely the same action occurs at the other end where the nibs 36 engage the corresponding projections of the elongated member 40.

In this condition, the elongated members 20 and 40 are securely interconnected and the wrenches 11 are retained between the heads 28 and 48. The steeper slope on the outer surface on each projection 32 reduces the chance of accidental disengagement.

If it is desired to remove all the wrenches 11, the reverse procedure is carried out. Specifically, the heads 28 and 48 are gripped and the elongated members 20 and 40 slid away from each other, thereby causing the nibs to ride up the projections 32 until they clear the same. The latching elements 30 and 35 are thus disengaged from the latching elements 50 and 55.

Alternatively, if as is more usually the case, a specific wrench 11 is desired, then the selected wrench and all those to one side of it are grasped in one hand and the rest of the wrenches are grasped in the other hand. As the contents of each hand are pulled away from each other, the latching elements become disengaged as before. The first set of wrenches will remain on one of the elongated members and the rest of the wrenches will remain on the other. When separated, the selected wrench can be withdrawn from its elongated member. The members 20 and 40 can be reassembled while the selected wrench is being used.

What has been described therefor is an improved, economical wrench holder which is easy to use. Its construction enables a user to remove any selected wrench without removing them all. Yet, the wrench holder securely retains all the wrenches when not in use.

What is claimed is:

1. A wrench holder for a set of wrenches each having an opening for receiving the shank end of a drive tool, comprising a pair of elongated members, each of said members including an elongated body and a pair of substantially parallel legs extending therefrom, the cross-sectional size of said body and said legs being less than the size of the wrench opening so that said body and said legs can be passed through and pulled out of such openings, the legs and the body of one of said elongated members slidably interfitting with the legs and the body of the other of said elongated members, each of said elongated members further including a head on the end of the body thereof remote from the associated legs, the cross-sectional size of each head being greater than the size of each wrench opening so that the wrenches are retained on the wrench holder when said legs are interfitted.

2. The wrench holder of claim 1, wherein said elongated members are substantially identical.

3. The wrench holder of claim 1, wherein said elongated members are composed of plastic.

4. The wrench holder of claim 1, wherein said elongated members includes latching means for releasably holding said elongated members in their interfitted condition.

5. The wrench holder of claim 1, wherein each opening of each wrench is substantially square and the transverse cross-sectional shape of each of said elongated members is substantially square.

6. The wrench holder of claim 1, wherein the length of the body of each of said elongated members is about equal to the length of each of said legs thereof.

7. A wrench holder for a set of wrenches each having an opening for receiving the shank end of a drive tool, comprising a pair of elongated members, each of said members including an elongated body and a pair of substantially parallel legs extending therefrom, the cross-sectional size of said body and said legs being less than the size of the wrench opening so that said body and said legs can be passed through and pulled out of such openings, each of said elongated members including a plurality of longitudinally extending planar slide surfaces which laterally converge, approximately one-half of each of said slide surfaces being on said body and one-half being on said legs, the legs and the body of one of said elongated members slidably interfitting with the legs and the body on the other of said elongated members such that said slide surfaces of one of said elongated members are in juxtaposition respectively with the slide surfaces of the other of said elongated members, each of said elongated members further including a head on the end of the body thereof remote from the associated legs, the cross-sectional size of each head being greater than the size of each wrench opening so that the wrenches are retained on the wrench holder when said legs are interfitted.

8. The wrench holder of claim 7, wherein each of said elongated members has four planar side surfaces.

9. The wrench holder of claim 7, wherein adjacent slide surfaces are about 90° apart.

10. The wrench holder of claim 7, wherein each of said elongated members has a longitudinally extending outer surface, approximately one-half of each of said outer surfaces being on said body and one-half on said legs, said outer surfaces concealing said slide surfaces when said elongated members are interfitted and defining a square in transverse cross-section.

11. The wrench holder of claim 7, wherein said elongated members are composed of plastic.

12. The wrench holder of claim 7, wherein said elongated members includes latching means for releasably holding said elongated members in their interfitted condition.

13. The wrench holder of claim 7, wherein each opening of each wrench is substantially square and the transverse cross-sectional shape of each of said elongated members is substantially square.

14. The wrench holder of claim 7, wherein the length of the body of each of said elongated members is about equal to the length of each of said legs thereof.

15. A wrench holder for a set of wrenches each having an opening for receiving the shank end of a drive tool, comprising a pair of elongated members, each of said members including an elongated body and a pair of substantially parallel legs extending therefrom, the cross-sectional size of said body and said legs being less than the size of the wrench opening so that said body and said legs can be passed through and pulled out of such openings, the legs and the body of one of said elongated members slidably interfitting with the legs and the body of the other of said elongated members, each of said elongated members further including a head on the end of the body thereof remote from the associated legs, the cross-sectional size of each head being greater than the size of each wrench opening so that the wrenches are retained on the wrench holder when said legs are interfitted, first latching means on said legs at the ends thereof remote from said body, and second latching means on said body at the end thereof remote from said legs, said first latching means on one of said elongated members engaging said second latching means on the other of said elongated members, said first latching means on said other elongated member engaging said second latching means on said one elongated member.

16. The wrench holder of claim 15, wherein each of said first latching means includes a receptacle and ramps leading to and from said receptacle, and each of said second latching means is a projection that rides up and down said ramps and snaps into and out of said receptacle.

* * * * *